US005192935A

United States Patent [19]

Yun

[11] Patent Number: 5,192,935

[45] Date of Patent: Mar. 9, 1993

[54] ATTACHMENT STRUCTURE OF A MAGNETIC PIECE OF A DEFLECTION YOKE

[75] Inventor: Sang-Hyeog Yun, Suwon, Rep. of Korea

[73] Assignee: Samsung Electron Devices Co. Ltd., Rep. of Korea

[21] Appl. No.: 794,580

[22] Filed: Nov. 19, 1991

[30] Foreign Application Priority Data

Nov. 22, 1990 [KR] Rep. of Korea ..... 90-18005

[51] Int. Cl.[5] ..... H01F 3/12; H01F 7/00

[52] U.S. Cl. ..... 335/211; 335/210; 335/214

[58] Field of Search ..... 335/210, 211, 212, 214; 313/440

[56] References Cited

U.S. PATENT DOCUMENTS

| | | | |
|---|---|---|---|
| 4,257,023 | 3/1981 | Kamijo | 335/211 |
| 4,386,331 | 5/1983 | Kohzuki | 335/211 |
| 4,433,268 | 2/1984 | Arisato | 313/440 |
| 4,636,684 | 1/1987 | Yokota | 335/211 |
| 4,788,470 | 11/1988 | Kohzuki | 313/440 |
| 5,014,029 | 5/1991 | Kawaguchi | 335/210 |
| 5,036,246 | 7/1991 | Germani | 313/440 |

FOREIGN PATENT DOCUMENTS

| | | | |
|---|---|---|---|
| 0001728 | 1/1985 | Japan | 335/210 |
| 0054144 | 3/1985 | Japan | 313/440 |
| 0119143 | 5/1988 | Japan | 313/440 |

*Primary Examiner*—Leo P. Picard
*Assistant Examiner*—Raymond Barrera
*Attorney, Agent, or Firm*—Majestic, Parsons, Siebert & Hsue

[57] ABSTRACT

The invention relates to an attachment structure of a magnetic piece of a defection yoke to be fixed to the center of a coil separator, and the invention is constructed such that a center protuberance 3 is formed by protruding at the center of a supporting base 2 of a coil separator 1, and a pair of opposed side protuberances 6 or a pair of opposed guiding member 8 provided with a guiding groove 7 which are made to support the right and left side surfaces of the magnetic piece 4 are integrally formed at the right and left of the center protuberance 3 whereby the shaking of the magnetic piece 4 is prevented, so that a misconvergence of the screen of a CRT tube can be effectively compensated.

2 Claims, 2 Drawing Sheets (a) [PRIOR ART]

(b) [PRIOR ART]

ATTACHMENT STRUCTURE OF A MAGNETIC PIECE OF A DEFLECTION YOKE

BACKGROUND OF THE INVENTION

1. Technical Field

The present invention relates to a deflection yoke fixed to a neck portion of a cathoderay tube. More particularly, this invention relates to an attachment structure of a magnetic piece of a deflection yoke which is fixed at a center of a coil separator in order to compensate a misconvergence in accordance with the difference of radii of curvature of a cathode ray tube screen.

2. Prior Art

Generally, a panel having a phosphor screen in a cathode-ray tube has a structure such that, in case where distance between an electron gun and a center of screen is defined as a reference radius, other radii deflected to horizontal and vertical directions are not same, and the more it goes to a peripheral portion of the screen, the more said radius of curvature increases. Because such difference of radius of curvature has been a cause of misconvergence, it has been made such that electron beam emitted from the electron gun is appropriately deflected by attaching the deflection yoke at front of the neck portion so that it reaches correctly on to the phosphor screen.

And yet, a product of saddle-toroidal type is generally used for said deflection yoke, and in the deflecting yoke of such structure, in case seeing from whole of magnetic field distribution, the horizontal deflecting coil is made in pin cushion type, while the vertical deflecting coil is made in barrel type.

In a structure of such deflecton yoke, in case when a beam emitted from the electron gun is deflected, it receives a barrel type magnetic field according to the vertical deflecting coil at a connecting portion of nect portion of the deflection yoke, and thereby a misconvergence that G beam of horizontal component of raster gets out from R and B beams in barrel type as shown in FIG. 2, and particularly a deterioration of raster of upper and lower portions of the phosphor screen is occurred very seriously, and in order to solve such disadvantage, said misconvergence is compensated by fixing a magnetic piece at a center between an opening portion and a neck portion of the coil separator.

Thus, the conventional attachment structure of the magnetic piece for compensating the misconvergence is as follows. Namely, as shown in FIG. 1, a magnetic piece 12 has been fixed to a coil separator 1 in a form that a supporting protuberance 11 having a predetermined height and length in protruded form at a central portion of the coil separator 1 is formed and a magnetic piece 12 made of concave and convex form is inserted to said supporting protuberance 11.

However, since said magnetic piece 12 is made in a structure which is supported by a supporting protuberance 11 inserted to a recess 13 formed at its central portion, in case where the deflecting coil is mounted on the coil separator 1, even if a small shock is applied to this, the magnetic piece 12 becomes to be shaken around the supporting protuberance 11, whereby a phenomenon becoming to be inclined to right and left is occurred, and according to this, the compensating magnetic field according to the magnetic piece 12 becomes to be deviated, therefore there has been occurred a problem that the electron beam becomes misconverged and distorted.

A technique has been also used heretofore in which, in order to prevent such misconvergence of electron beam, a magnetic piece is fixed to the supporting protuberance and then an adhesive tape is sticked between the magnetic piece and the coil separator so that the magnetic piece is fixed on the coil separator, however, this has produced a problem that, in case when the adhereing force of said adhesive tape would become weakened, the magnetic piece becomes to be inclined around said supporting protuberance as aforementioned, whereby it becomes to further add a bad effect according to the misconvergence.

OBJECT AND SUMMARY OF THE INVENTION

Accordingly, the present invention is made to solve such problems with conventional attachment structure of a magnetic piece of a deflection yoke. It is an object of the present invention to provide an improved attachment structure of a magnetic piece of a deflection yoke in which a supporting means capable of preventing the inclination of the magnetic piece is formed at right and left around the center protuberance so that said magnetic piece can be firmly fixed without being inclind to right or left on the coil separator.

In order to attain such above-described object, the present invention is characterized with a structure in which a protuberance is protruded at center of supporting base of the coil separator, and a supporting means such as a supporting protrusion or a guiding member having a guiding groove ar integrally formed at right and left of said supporting protuberance, and thereby right and left side surfaces of the supporting base are firmly supported so that it can be fixed so as to prevent the inclination thereof.

The forgoing and other objects as well as advantages of the present invention will become clear by following description of the invention with reference to the accompanying drawings.

BRIEF DESCRIPTION OF THE DRAWINGS

For a better understanding of the invention, and to show how the same may be carried into effect, reference will now be made, by way of example, with respect to the accompanying drawings, in which:

FIG. 1(*b*) is a fragmentary cross sectional view of an essential part of FIG. 1(*a*)

DETAILED DESCRIPTION OF THE PREFERRED EMBODIMENT

Hereinafter, a preferred embodiment of the present invention will be described in detail with referencce to the accompanying drawings.

Figure 1:
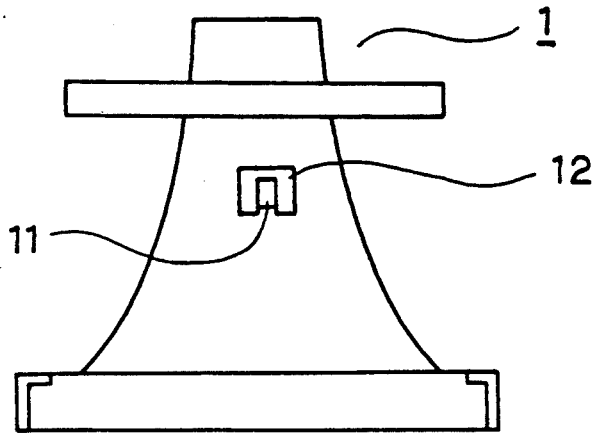
FIG. 1(*a*) is a front view for showing a state that a magnetic piece is mounted to an attachment structure formed on a conventional coil separator.
Figure 1:
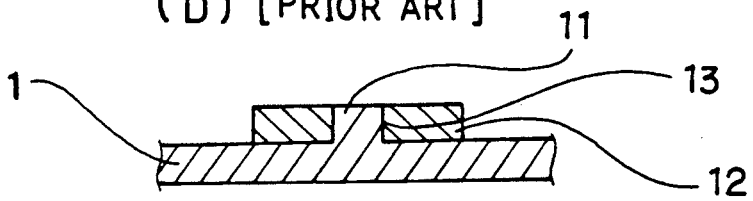
Figure 2:
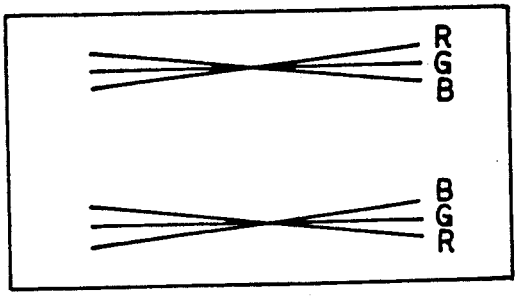
FIG. 2 [PRIOR ART]
FIG. 2 is a schematic diagram for showing a state of misconvergence in a raster according to the conventional attachment structure of a mgnetic piece, FIG. 3(*a*) is a front view for showing a state that a magnetic piece is mounted to an attachment structure formed on the coil separator according to the present invention, FIG. 3(*b*) is a fragmentary cross sectional view of an essential part of FIG. 3(*a*)
Figure 3:
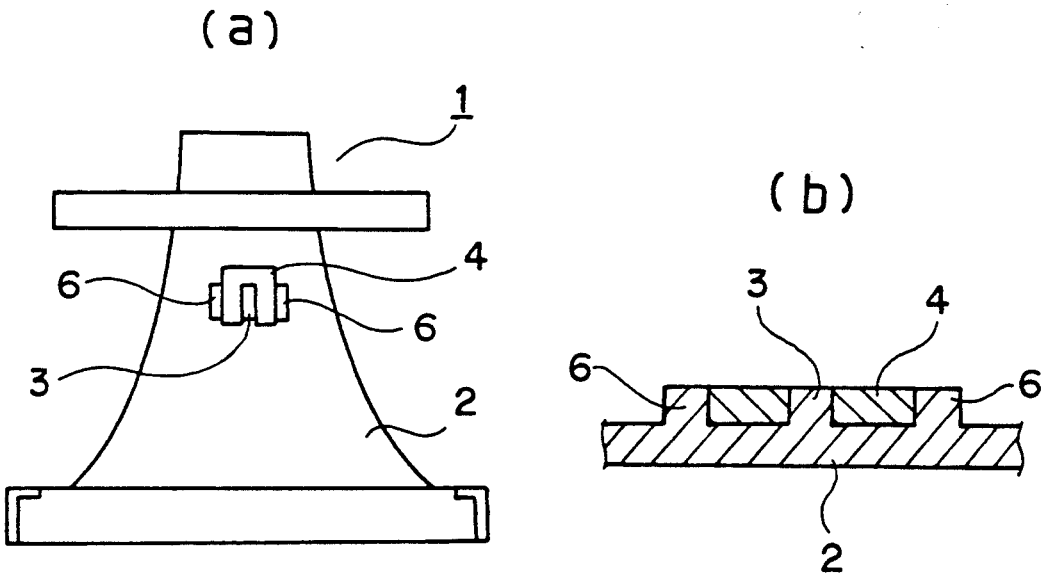

As shown in FIG. 3, a coil separator 1 is constructed by coupling a pair of right and left supporting bases 2 each other, a horizontal coil (not shown) is mounted at inner side of said coil separator 1, and a vertical coil (not shown) wound with a coil wire to a ferrite core (not shown) is mounted to its outer side to thereby make a deflection yoke.

On the other hand, in the present invention, a protuberance 3 having a predetermined height and length is formed by protruding at the center of a pair of supporting bases 2 making said coil separator 1 so that a recess 5 formed at the bottom end center of a magnetic piece 4 can be inserted, and supporting means 6 for supporting the right and left side surfaces of the magnetic piece 4 are respectively provided at the right and left of said center protuberance 3, wherein said supporting means 6 is formed with same height as said center protuberance 3, and said supporting means 6 supports the right and left side surfaces of the magnetic piece 4 to thereby prevent that the magnetic piece 4 is inclined or shaken.

Figure 4:
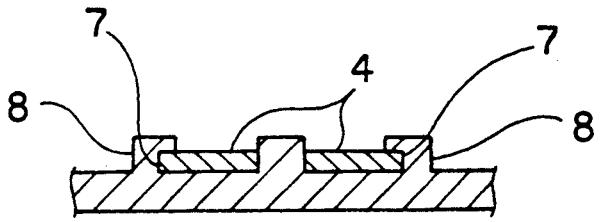
FIG. 4 is a fragmentary cross sectional view of an essential part showing a fixing state of the magnetic piece according to another embodiment of the present invention.

On the other hand, as another embodiment of the present invention, as shown in FIG. 4, an attachment structure of the magnetic piece of a deflection yoke can also be constructed such that a guiding member 8 having a guiding groove 7 is formed at the right and left of the center protuberance 3 instead of said supporting means 6 so that the right and left surfaces of said magnetic piece 4 are securely supported by inserting into the guiding member 8 along with the guiding groove 7.

In each of two embodiments of the present invention constructed as above description, the former is easy to make the attachment structure but the supporting strength is less than the latter, on the contrary to this, the latter is high in the supporting strength but it has a little difficult point to manufacture its form than the former, accordingly it is desirable to apply by selecting any one attachment structure of these two embodiments in accordance with the requirement of the product.

Figure 5:
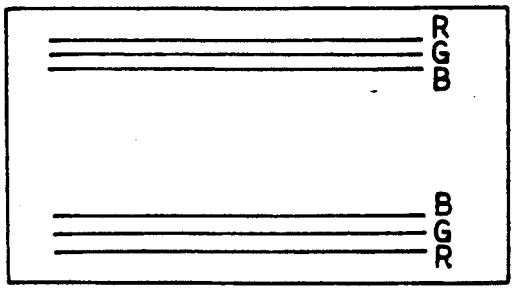
FIG. 5 is a schematic diagram of a compensated state of misconvergence of a screen according to an attachment structure of magnetic piece of the present invention, Throughout the drawings, like reference numerals and symbols are used for designating like or equivalent parts or portions, for simplicity of illustration and explanation.

As in the above description, according to the present invention, a center protuberance 3 of a projecting form is formed to the center of a supporting base 2 of the coil separator 1 and simultaneously each of two supporting means are separately formed at the right and left of said center protuberance 3 whereby the central portion of the magnetic piece 4 is primarily fixed to said center protuberance 3, and secondarily the right and left side surfaces of the magnetic piece 4 are firmly fixed by said supporting means 6 so that the shaking of the magnetic piece 4 on the center protuberance 3 can be effectively prevented, and according to this, as shown is FIG. 5, the invention has an advantage that any misconvergence of the screen can be effectively compensated.

It will be appreciated that the present invention is not restricted to the particular embodiment that has been described hereinbefore, and that variations and modifications may be made therein without departing from the spirit and scope of the invention as defined in the appended claims.

What is claimed is:

1. An attachment structure for a magnetic piece of a deflection yoke to be firmly fixed to a central part of a coil separator, said attachment structure comprising:

a center protuberance formed at the center of a supporting base of said coil separator, said center protuberance contacting said magnetic piece; and supporting means integrally formed with said center protuberance for supporting the right and left side surfaces of said magnetic piece, said supporting means comprising two members respectively at the right and left of said center protuberance and protruding with the same height as said center protuberance.

2. An attachment structure for a magnetic piece of a deflection yoke according to claim 1, wherein said two members are guide members on the right and left of the center protuberance with the magnetic piece therebetween, said guide members having guiding grooves to engage said magnetic piece.

* * * * *